US006333496B1

(12) United States Patent
Risman et al.

(10) Patent No.: US 6,333,496 B1
(45) Date of Patent: Dec. 25, 2001

(54) MICROWAVE FEEDING OF AN OVEN CAVITY

(75) Inventors: Per Olov Risman, Harryda; Dan Carlsson; Ulf Nordh, both of Norrkoping, all of (SE)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 09/367,375

(22) PCT Filed: Feb. 9, 1998

(86) PCT No.: PCT/EP98/00711

§ 371 Date: Oct. 27, 2000

§ 102(e) Date: Oct. 27, 2000

(87) PCT Pub. No.: WO98/36619

PCT Pub. Date: Aug. 20, 1998

(30) Foreign Application Priority Data

Feb. 13, 1997 (SE) ..... 9700530

(51) Int. Cl.[7] ..... H05B 6/70; H05B 6/72

(52) U.S. Cl. ..... 219/746; 219/748; 219/695; 333/230

(58) Field of Search ..... 219/746, 748, 219/750, 749, 695, 697; 333/252, 248, 230

(56) References Cited

U.S. PATENT DOCUMENTS

| | | | | |
|---|---|---|---|---|
| 3,764,770 | * | 10/1973 | Saad et al. | 219/746 |
| 4,159,406 | * | 6/1979 | Tate et al. | 219/746 |
| 5,825,000 | * | 10/1998 | Jun | 219/746 |
| 5,880,442 | * | 3/1999 | You | 219/746 |
| 5,973,306 | * | 10/1999 | Lee | 219/746 |

FOREIGN PATENT DOCUMENTS

| | | | |
|---|---|---|---|
| 684 373 | * | 8/1994 | (CH) . |
| 0 430 584 | * | 6/1991 | (EP) . |
| 0 500 036 | * | 8/1992 | (EP) . |

* cited by examiner

*Primary Examiner*—Philip H. Leung
(74) *Attorney, Agent, or Firm*—Joel M. Van Winkle; Robert O. Rice; Thomas J. Roth

(57) ABSTRACT

A device and a method for microwave feeding of an oven cavity by means of a coupling slot (1) which is fed by a waveguide. The a-dimension of the waveguide is significantly larger than the effective a-dimension of the slot. The slot comprised a radiating main slot part (5) and slot extensions (6,7) projecting from it at its respective sides, which extension have a substantially smaller cross-dimension than the b-dimension of the main slot part.

12 Claims, 1 Drawing Sheet

MICROWAVE FEEDING OF AN OVEN CAVITY

FIELD OF THE INVENTION

The present invention relates to microwave feeding of a cavity in a microwave oven employing an elongated coupling slot made in a cavity wall, which slot is fed from a waveguide externally connected thereto.

TECHNICAL BACKGROUND

The dimensioning of coupling slots for microwave feeding of the kind mentioned above often causes a number of problems. The achievement of good fixing, that is, good galvanic contact, between the feeding waveguide and the cavity wall can be problematic because of inaccessibility for spot welding means which at the time of manufacture have to be inserted into and behind the slot opening in connection with the spot welding of the waveguide to the cavity. As will be appreciated, this leads to constructive limitations.

For technical microwave reasons it is often desirable that the width (so-called a-dimension) of the feeding waveguide be maintained in the whole slot area, despite the fact that the width (a-dimension) of the selected coupling slot is significantly smaller than the a-dimension of the waveguide. This can cause problems with the required spot welding in view of the plate bending desired in connection with manufacturing, as well as with concentrations of conduction current in the cavity wall plate adjacent to the slot in the area between the respective slot ends and the side wall connection associated with the waveguide. The latter is particularly pronounced in connection with simple coupling slots of the so-called H-type and when TE10 mode fields are employed.

OBJECTS OF THE INVENTION

A main object of the present invention is to make possible microwave feeding employing a relatively small coupling slot while achieving essentially the type of field pattern which can be provided by a slot with a small a-dimension, despite the fact that the feeding waveguide employed has a considerably larger a-dimension than the coupling slot employed.

Another object of the present invention is substantially to obviate the problems described above.

A further object of the present invention is to make possible microwave feeding with increased flexibility with respect to the constructive design of the coupling slot in the cavity wall and the connection thereto of the feeding waveguide.

Yet another object of the present invention is to make possible microwave feeding which provides an additional degree of constructive freedom with respect to the action on the wall current distribution in the slot area and thereby the excitation of the cavity and the heating pattern for certain loads.

SUMMARY OF THE INVENTION

The above-mentioned objects are achieved by a device and a method which exhibit the features stated in the appended claims.

The basis of the invention is thus that it has been found possible with simple means to affect the current distribution in the cavity wall areas on each side of the microwave radiating slot part out towards the respective side walls of the feeding waveguide. Such action can be achieved according to the invention by the slotting of said areas from the radiating slot part, whereby such current paths as would exist in the absence of slotting are cut off, which leads to a more even current distribution without current concentrations occurring in the areas in question.

It has been found that such a changed current distribution does not affect the excitation of the cavity fields unfavourably, but that the risk of overheating and major current losses in the areas in question is significantly reduced. In addition, said action can be utilised to favourably adjust the excitation and the heating pattern of the cavity, as well as the impedance matching, with a basic configuration as the starting point. In other words, an extra degree of freedom can be obtained.

The slotting according to the invention can be seen as the arrangement of an extension of the radiating coupling slot, that is, of its main part, and is effected in such a way that no appreciable microwave radiation into the cavity is obtained directly from the extra slot areas achieved as a result of the slotting. In other words, these additional slot areas will have the nature of secondary surfaces to the radiating main surface of the coupling slot. The slots are thus made narrow, that is, with a small height- or cross-dimension. This is possible because the flash-over risk will be minimal, since the electric field (in the slot plane) is at its lowest level in the areas in question and increases towards the radiating main part of the coupling slot, something which applies to, for example, TE10 mode fields.

Behind each secondary slot surface a "pocket" is created in the feeding waveguide which, depending on the geometry, will constitute an inductive or capacitive member, as well as a capacitive stretch between the cavity wall at the secondary slot surface and the opposite waveguide wall. Seen from the waveguide, the pocket will function as if it were at least substantially closed, that is, as if the extra slotting did not exist. This makes it possible to affect both the field image of the coupling slot and the wave impedance for the propagating mode of the waveguide.

With respect to the required galvanic contact between the cavity and the waveguide it has been found that the invention provides better constructive opportuities for spot connections with a mutual spacing which eliminates microwave leakage between the waveguide and cavity plates. In this connection, it is also important to note that when microwave fields of the TE10 type are concerned, the power flux density which can arise at the secondary slot areas is relatively speaking very small, which further obviates any leakage problems.

According to a first aspect of the invention, a device for microwave feeding of a cavity in a microwave oven is provided, comprising an elongated coupling slot made in a cavity wall and a waveguide externally connected thereto, the coupling slot at the respective slot ends having a slot extension with a substantially smaller height- or cross-dimension in relation to the b-dimension of the main part of the coupling slot. In this connection, it is a preferred feature that the a-dimension of the main part of the coupling slot together with the length dimension of the slot extensions essentially correspond to the a-dimension of the connected waveguide.

Advantageously, the coupling slot has an essentially rectangular main part, from which a slot extension originates at each short end. The slot extensions can have an essentially constant cross-dimension, that is, have an essentially rectangular shape, or alternatively, in the direction away from the main part of the coupling slot, have a decreasing cross- or height-dimension.

Preferably, the slot edge of the cavity wall is rounded in the wall plane at least in an upper transition between the main part of the coupling slot and the respective slot extensions. This results in the formation of a configuration which can be compared to a "curtained" slot.

Although it has been found suitable that the respective slot extensions form an extension, projecting directly outwards, of the lower edge area of the main part of the coupling slot, the skilled person will appreciate that the slot extensions can be arranged at a different height relative to the slot, e.g. at the top (reversed "curtain configuration") or symmetrically on the halfway point of the slot.

For a 2450 MHz microwave oven for domestic use, an effective slot cross-dimension, that is b-dimension, which typically is about 10 times greater than the cross-dimension of the slot extensions, has been found suitable.

According to a second aspect of the invention, a method is provided for feeding microwaves into the cavity of a microwave oven through an elongated coupling slot, which is fed by an external waveguide, employing a coupling slot whose effective a-dimension is significantly smaller than the a-dimension of the waveguide, which method comprises the adaptation of the coupling slot to the waveguide and the desired cavity excitation by the connection of a slot extension, whose cross-dimension is substantially smaller than the b-dimension of the main part of the coupling slot, to each end of the main part of the coupling slot. The slot extensions are preferably dimensioned so that no appreciable microwave radiation is received directly from the slot extensions into the cavity.

It is a preferred feature that the extent given to the slot extensions is such that together with the a-dimension of the main part of the coupling slot they essentially correspond to the a-dimension of the connected waveguide.

It will be appreciated that subsequent to the arrangement of the slot extensions on the basis of a basic configuration with a certain given slot main part, it is possible to further adapt the microwave feeding to the existing conditions by readjusting the dimensions of the main part, in particular its a-dimension and/or b-dimension.

The invention will be described in more detail below by way of an embodiment with reference to the accompanying drawing.

DESCRIPTION OF EMBODIMENT

Figure 1:
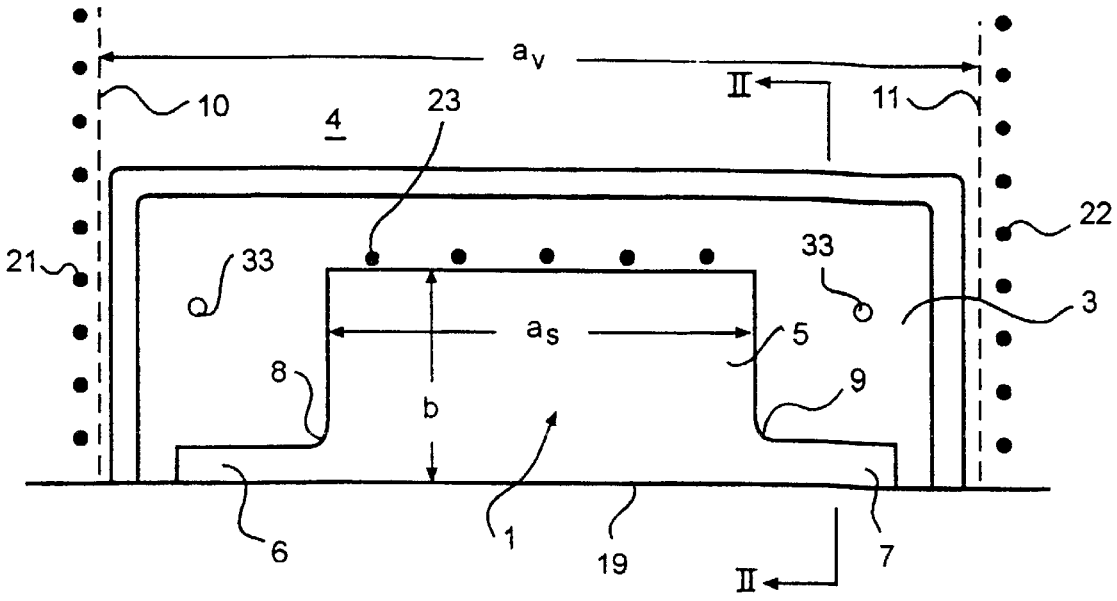
FIG. 1 is a schematic vertical partial view of a coupling slot in a cavity side wall in a microwave oven, the view being taken from inside the cavity.
Figure 2:
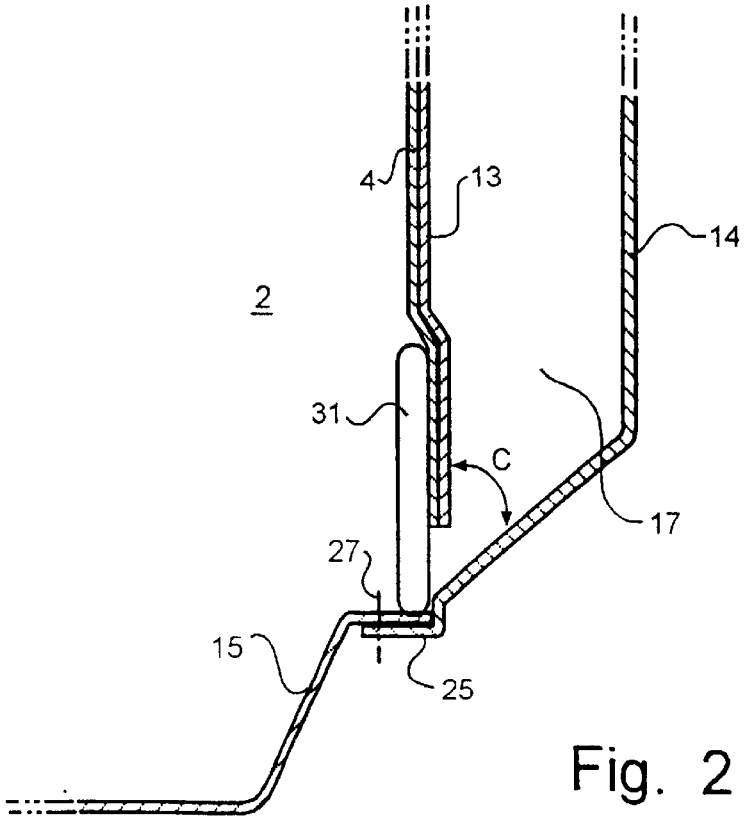
FIG. 2 is schematic vertical partial sectional view taken along line II—II in FIG. 1.

FIGS. 1 and 2 illustrate an example of the arrangement of a coupling slot according to the invention in an otherwise conventional microwave oven for domestic use. The coupling slot 1 is arranged in a stamped (seen from inside the cavity room 2), rectangular slot wall area 3 in the lower part of a cavity wall 4. The coupling slot 1 comprises a rectangular main part 5, which in its lower part is provided with rectangular slot extensions 6, 7 extending to each side. The connection between the respective slot extensions 6 and 7 and main slot part 5 is rounded at the top, as shown at 8, 9. The slot extensions 6, 7 essentially extend to the side walls of the posteriorly situated feeding waveguide, which side walls are indicated by dashed lines 10, 11. The width of the waveguide, that is its a-dimension $a_v$, corresponds to the width of the stamped area 3. The effective a-dimension of the coupling slot is $a_s$, that is, the width of the main part 5. The b-dimension of the main part is designated b in FIG. 1.

In addition to the indicated side walls 10, 11, the feeding wave guide has a front wall 13, which is galvanically connected to and follows the cavity wall 4, and a back wall 14, whose lowest part extends obliquely downwards forwards and under the coupling slot 1 while forming the straight lower edge 19 of the slot, to connect with the underside of the cavity bottom 15.

As seen in FIG. 2, a special pocket 17 is formed with a capacitive stretch C behind each slot extension 6, 7, that is, between the back wall 14 of the waveguide and the "curtain-like" part of the wall area 3 (see FIG. 1) with the posteriorly situated front waveguide wall 13 which is located above the slot extension. As mentioned above, the configuration provided by said pocket will affect the microwave conditions.

The waveguide is connected to the cavity by a number of spot welds. The side walls 10 and 11 of the waveguide are connected to the front wall 13 of the waveguide (and thereby indirectly to the cavity wall 4) by vertical rows of spot welds 21, 22. At the bottom, the front wall 13 of the waveguide is connected to the wall area 3 above the upper edge of the main slot part 5 by a horizontal row of spot welds 23. Finally, the lower end part 25 of the back wall 14 of the waveguide is connected to the overlapping cavity bottom 15 by a horizontal row of spot welds (of which one is indicated at 27) which extends along the whole wall area 3, that is, along the whole width of the waveguide.

All of the spot welds mentioned above are easy to achieve from a manufacturing point of view and have been found to provide fully adequate galvanic contact and sealing against microwave leakage. In this connection, it is of particular interest that the lack of spot welds in the "curtain parts" of the wall area 3 have not been found to cause any problems. This is particularly pronounced when non-spot-welded stretches are less than ¼ free microwave length.

It is suitable to cover the coupling slot in the usual manner with a protective plate, e.g. a micanite plate, as is indicated at 31 in FIG. 2. This plate is dimensioned so that it fits sealingly into the stamped wall area 3 while connecting to the cavity bottom 15, which provides an even cavity wall and an attractive overall impression. The protective plate 31 is suitably attached with the aid of screws which are fixed in holes 33 in the wall area 3, whereby, simultaneously, an extra connection and galvanic contact between the cavity wall 4 and the posteriorly situated waveguide wall 13 are achieved.

The following dimensions are provided as an example of the dimensioning of a construction according to FIGS. 1 and 2 of a microwave oven intended for domestic use:

A-dimension of the waveguide about 105 mm,

A-dimension of the coupling slot about 80 mm,

Length of slot extension about 13 mm,

Height of slot extension about 2 mm.

What is claimed is:

1. In a microwave oven comprising a cavity (2) and a device for microwave feeding of the cavity, the device comprising an elongated coupling slot (1) including a main part (5) having a cross-dimensional (b) made in a cavity wall (4) and an external waveguide (13, 14) connected thereto, characterised in that the coupling slot (1) at the respective slot ends has a slot extension (6, 7) substantially in the plane of the coupling slot and having a substantially smaller cross-dimension than the cross-dimension (b).

2. A device according to claim 1 characterised in that the coupling slot (1) has an essentially rectangular main part (5), from which the slot extensions (6, 7) originate.

3. A device according to claim 1 or 2, characterised in that the slot extensions (6, 7) have an essentially rectangular shape.

4. A device according to claim 1 or 2, characterised in that the slot extensions (6,7) have a decreasing cross-dimension in the direction away from the main part (5) of the coupling slot (1).

5. A device according to claim 1 or 2, characterised in that the slot edge of the cavity wall (4) is rounded in the wall plane at least in an upper transition (8, 9) between the main part (5) of the coupling slot (1) and the respective slot extensions (6, 7).

6. A device according to claim 1, characterised in that the width ($a_s$) of the main part of the coupling slot (1) together with the length dimension of the slot extensions (6, 7) correspond to the width ($a_v$) of the connected waveguide (13, 14).

7. A device according to claim 1, characterised in that the respective slot extensions (6, 7) constitute an extension, projecting directly outwards, of the lower edge area of the main part (5) of the coupling slot (1).

8. A device according to claim 1, characterised in that the main part (5) of the coupling slot (1) has a cross-dimension (b) which typically is 10 greater than the cross-dimension of the slot extensions (6, 7).

9. A method for feeding microwaves into the cavity of a microwave oven through an elongated coupling slot (1) including a main part (5) having a cross-dimension (b), which is fed by an external waveguide (13, 14), employing a coupling slot whose effective width ($a_s$) is significantly smaller than the width ($a_v$) of the waveguide, characterised by adapting the coupling slot (1) to the waveguide and the desired cavity excitation by connecting slot extensions (6, 7) whose cross-dimension is substantially smaller than cross-dimension (b) to the respective ends of the main part (5) of the coupling slot (1) substantially in the plane of the coupling slot (1).

10. A method for feeding microwaves into the cavity of a microwave oven through an elongated coupling slot (1) including a main part (5) having a cross-dimension (b), which is fed by an external waveguide (13, 14), employing a coupling slot whose effective width ($a_s$) is significantly smaller than the width ($a_v$) of the waveguide, characterised by adapting the coupling slot (1) to the waveguide and the desired cavity excitation by connecting slot extensions (6, 7) to the respective ends of the main part (5) of the coupling slot (1) further characterised by giving the slot extensions (6, 7) a cross-dimension substantially smaller than cross-dimension (b) and an extent such that together with the width ($a_s$) of the main part (5) of the coupling slot (1) the coupling slot (1) and slot extensions (6, 7) essentially correspond to the width ($a_v$) of the connected waveguide.

11. A method to claim 9 or 10, characterised by readjusting, after the arrangement of slot extensions (6, 7) the dimensions of the main part (5) of the coupling slot (1).

12. A method according to claim 9 or 10, characterised by dimensioning the slot extensions (6, 7) so that no appreciable microwave radiation is received directly from the slot extensions (6, 7) into the cavity (2).

* * * * *